US005580275A

United States Patent [19]

Bozek

[11] Patent Number: 5,580,275

[45] Date of Patent: Dec. 3, 1996

[54] HEATED ELECTRICAL COUPLER

[75] Inventor: Raymond Bozek, Peekskill, N.Y.

[73] Assignee: Cox & Company, Inc., New York, N.Y.

[21] Appl. No.: 599,919

[22] Filed: Feb. 12, 1996

[51] Int. Cl.[6] ..... H01R 33/945

[52] U.S. Cl. ..... 439/577; 439/193; 213/1.3; 219/209

[58] Field of Search ..... 439/34, 35, 161, 439/196, 485, 359, 193, 577, 289, 700; 213/1.3, 1.6; 219/209, 200–202

[56] References Cited

U.S. PATENT DOCUMENTS 4,303,301 12/1981 Teichert et al. ..... 385/75

4,957,208 9/1990 Ta ..... 439/359

*Primary Examiner*—Neil Abrams

*Assistant Examiner*—Brian J. Biggi

[57] ABSTRACT

An electrical heating element is provided in the coupler body of a coupler of the type used for railroad applications. The heating element heats the coupler to evaporate moisture and to prevent ice from forming. This lengthens the service life of the pin assemblies and reduces the frequency with which the coupler requires servicing.

7 Claims, 3 Drawing Sheets

HEATED ELECTRICAL COUPLER

BACKGROUND OF THE INVENTION

The invention relates to electrical couplers, and more particularly relates to electrical couplers that are used in environmentally exposed applications. In its most immediate sense, the invention relates to electrical couplers such as those used between railroad cars.

Typically, electrical connections between adjacent railroad cars are made using pairs of couplers. Each coupler is connected to an end of a car. When two cars are connected to each other (as by adding a car to the end of an existing train) the couplers at the adjacent ends of the cars are also connected to each other. Each coupler has a plurality of spring-loaded electrically conductive pins, and when adjacent cars are connected together corresponding pins on the couplers press against each other to establish the necessary electrical connections between the cars. In use, corresponding pins on the couplers can move in and out, but are urged outwardly from the couplers so as to be butted tightly against each other because of the forces exerted by the springs. With such a structure, the electrical connection between each two corresponding pins may be maintained even when the train travels around a curve; the pins on the inside of the curve are pressed inwardly against the springs to accommodate the reduced distance between the cars, and the pins on the outside of the curve are urged outwardly by the springs to make up for the increased distance between the cars. It may therefore be understood that motion of the pins is necessary to maintain the desired electrical connections between adjacent cars; if the motion does not occur, the desired electrical connections will not be maintained when the cars move with respect to each other (as when rounding a curve). In such instances, corresponding pins will become separated from each other, causing open circuits and arcing.

Conventional couplers fail because the pins become stuck in position. This in turn comes about because the couplers are exposed to the weather, and over time moisture gets into the pin mechanisms. The moisture causes corrosion, which in turn causes the pins to bind. Furthermore, even if corrosion has not yet occurred, cold weather causes the moisture to freeze and therefore likewise causes the pins to bind. While bound-in-position pins will sometimes break free as the couplers move towards and away from each other during use, the pin mechanisms eventually fail so that pin motion cannot be restored. When this happens, the coupler must be serviced.

It would be advantageous to provide an electrical coupler that would be less subject to failure caused by corrosion from moisture or by freezing during cold weather.

In accordance with the invention, a heated coupler is provided. The coupler has a plurality of electrical connectors. Each connector has a generally cylindrical body, a spring-loaded, electrically conductive pin retained within the body in such a manner as to project axially outwardly from the body and as to be capable of moving axially inwardly into the body against spring pressure when so urged by a mating pin on a mating coupler, and a terminal for making an electrical connection with the pin. The coupler also has a coupler body. The coupler body has a front surface, a rear surface and a like plurality of recesses extending between the front and rear surfaces. Each recess is dimensioned to receive a corresponding one of the connectors in such a manner that the pins project forwardly out of the front surface of the coupler body and the terminals project rearwardly out of the rear surface of the coupler body. The coupler also has an electrical resistance element located in the coupler body adjacent the rear surface, and a backing plate having a like plurality of holes, the backing plate being secured to the coupler body and retaining the connectors therein in such a manner that the terminals project through the holes for connection to a wiring harness.

Advantageously, and in accordance with the preferred embodiment, the connectors and recesses are arranged in elongated rows. The coupler body has channels in the rear surface and the channels extend between each two adjacent rows. The electrical resistance element is located in the channels and the channels are sealed with an epoxy adhesive. Advantageously, a thermostat is used to keep the temperature of the coupler body within a predetermined range.

Experiments with prototypes of the invention have shown that the electrical resistance element delivers sufficient heat to prevent freezing and to evaporate moisture on the pins in cold weather as well as warm weather. This dries out the pin mechanisms of the coupler before moisture can cause corrosion and before moisture can turn to ice, thereby prolonging the service life of the pin mechanisms and reducing the frequency with which the coupler must be serviced. Additionally, the electrical resistance element is not subject to any substantial mechanical forces and therefore can be expected to require little servicing on its own. Furthermore, these results are achieved without so raising the temperature of the coupler as to present a possible hazard to maintenance personnel.

BRIEF DESCRIPTION OF THE DRAWINGS

The invention will be better understood with reference to the following illustrative and non-limiting drawings, in which.

DETAILED DESCRIPTION OF PREFERRED EMBODIMENTS

A conventional 97-pin railroad coupler pair, as manufactured by Westinghouse Air Brake Company (Wilmerding PA) has a first coupler generally indicated by reference number 2 and a second coupler generally indicated by reference number 4. (The first and second couplers 2 and 4 are identical, and for this reason only coupler 2 will be described below.) Such couplers develop problems from moisture and from cold weather and require servicing. The reason for these problems will be discussed with reference to FIGS. 2 and 3.

Figure 1:
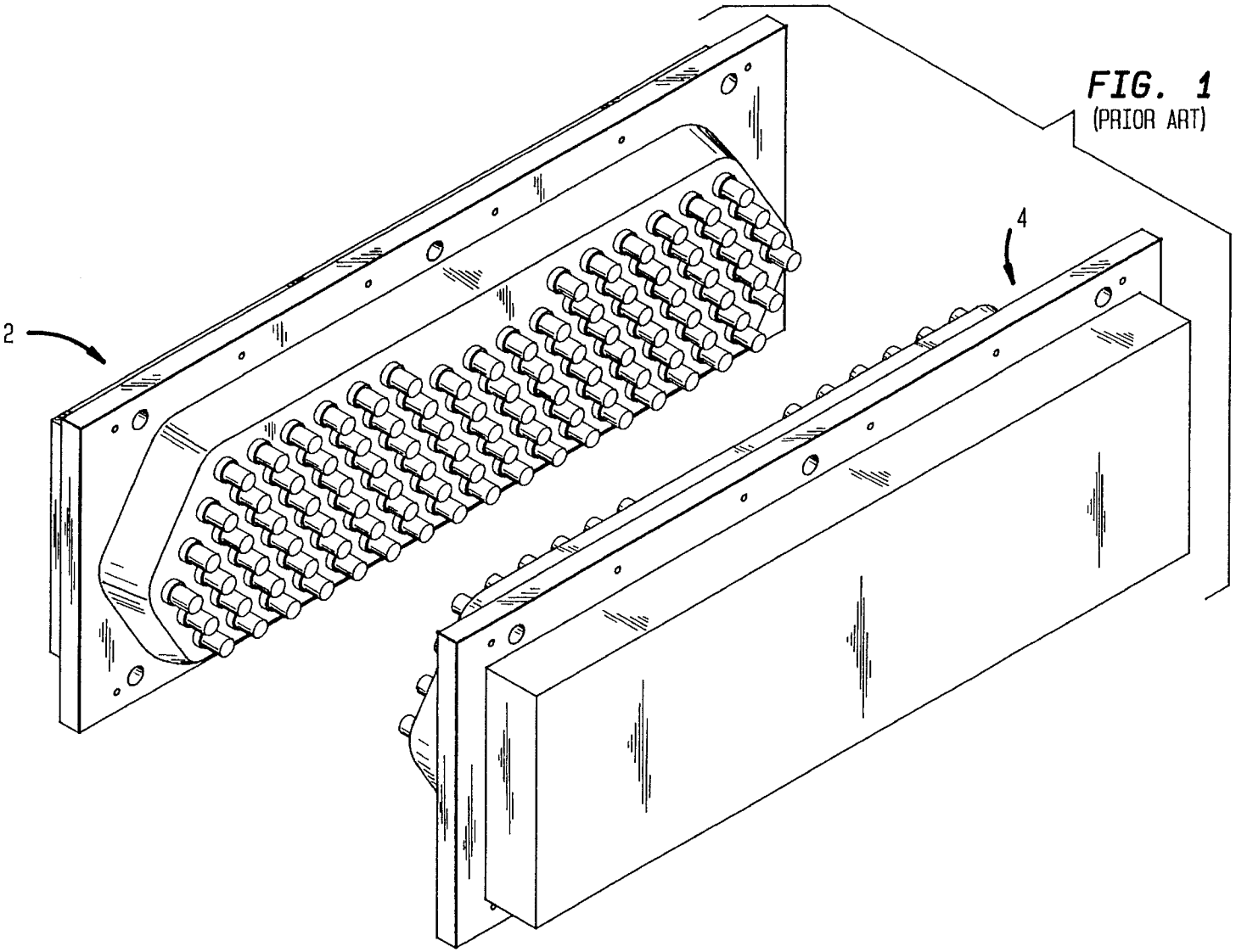
FIG. 1 (PRIOR ART)
FIG. 1 shows a conventional pair of couplers.
Figure 2:
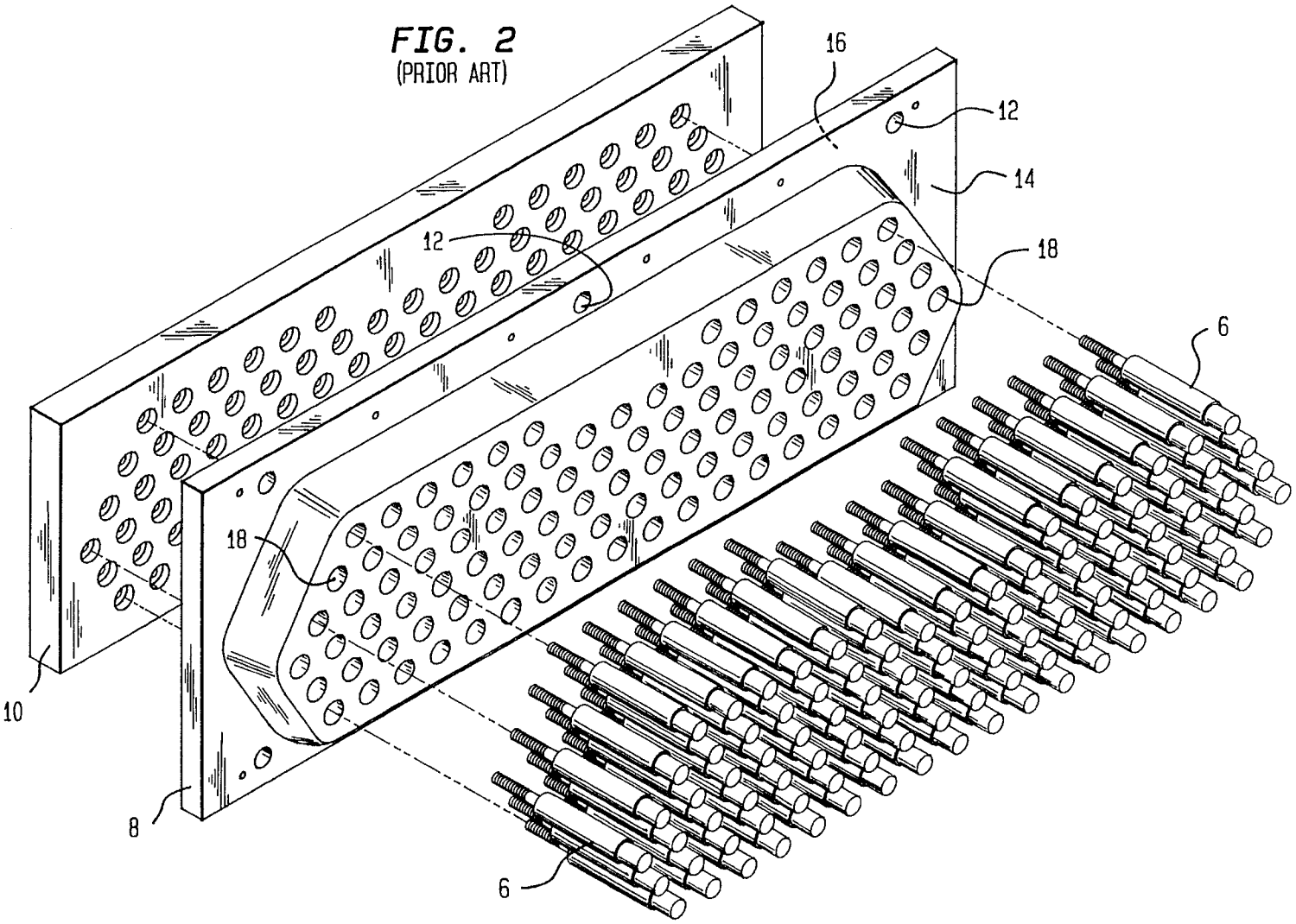
FIG. 2 (PRIOR ART)
FIG. 2 shows an exploded drawing of a conventional coupler.

As shown in FIG. 2, the first coupler 2 has 97 identical electrical connectors 6, each held within a coupler body 8 and retained therein by a backing plate 10 that is detachably secured to the coupler body 8 (as by screws in holes 12). The coupler body 8 has a front surface 14 and a rear surface 16, and recesses 18 extend between the front and rear surfaces 14 and 16. With this structure, the electrically conductive pins 20 described in more detail below project forwardly from the front surface 14, and the terminals 22 for the electrical connectors 6 project rearwardly out of the backing plate 10.

Figure 3:
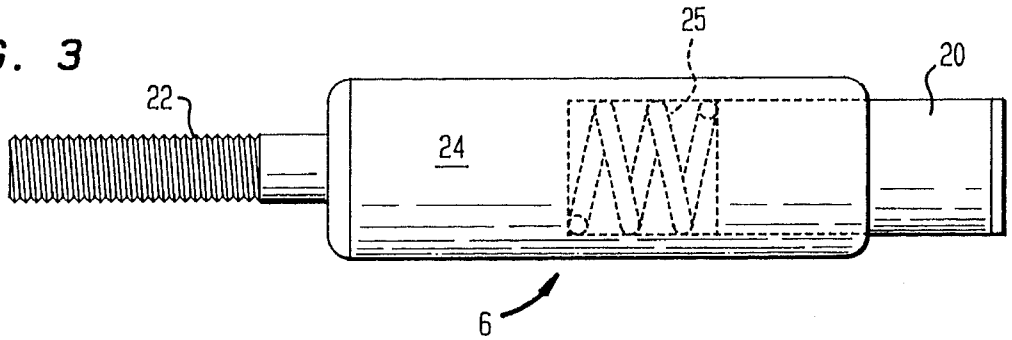
FIG. 3 shows a conventional electrical connecter such as is used in a conventional coupler.

As shown in FIG. 3, each electrical connector 6 has an exterior housing 24, an electrically conductive pin 20, a terminal 22 and an interior compression spring 25 (shown in phantom). The pin 20 is spring-loaded to move outwardly; as shown, the spring 25 has pushed the pin 20 to its fully extended position. However, by forcing the distal end of the pin 20 inwardly, the pin 20 can be moved into the body 24 against the pressure of the spring 25.

In use, moisture gets between the pins 20 and the bodies 24. This moisture causes corrosion, which in turn causes the pins 20 to bind and thereby fail to move freely into and out of the bodies 24. Additionally, when the weather gets cold enough, the moisture freezes. This likewise prevents the pins 20 from moving freely into and out of the bodies 24. While in certain instances free motion of the pins 20 may be restored by applying sufficient force on their distal ends to break them free of the bodies 24, this cannot be repeated indefinitely. After a sufficient number of such binding-breaking cycles, the pins 20 and/or the bodies 24 become worn and/or deformed. The result of this is to permit yet more water and debris to enter the electrical connectors 6, causing them to fail and requiring that they be replaced by servicing the first coupler 2.

Figure 4:
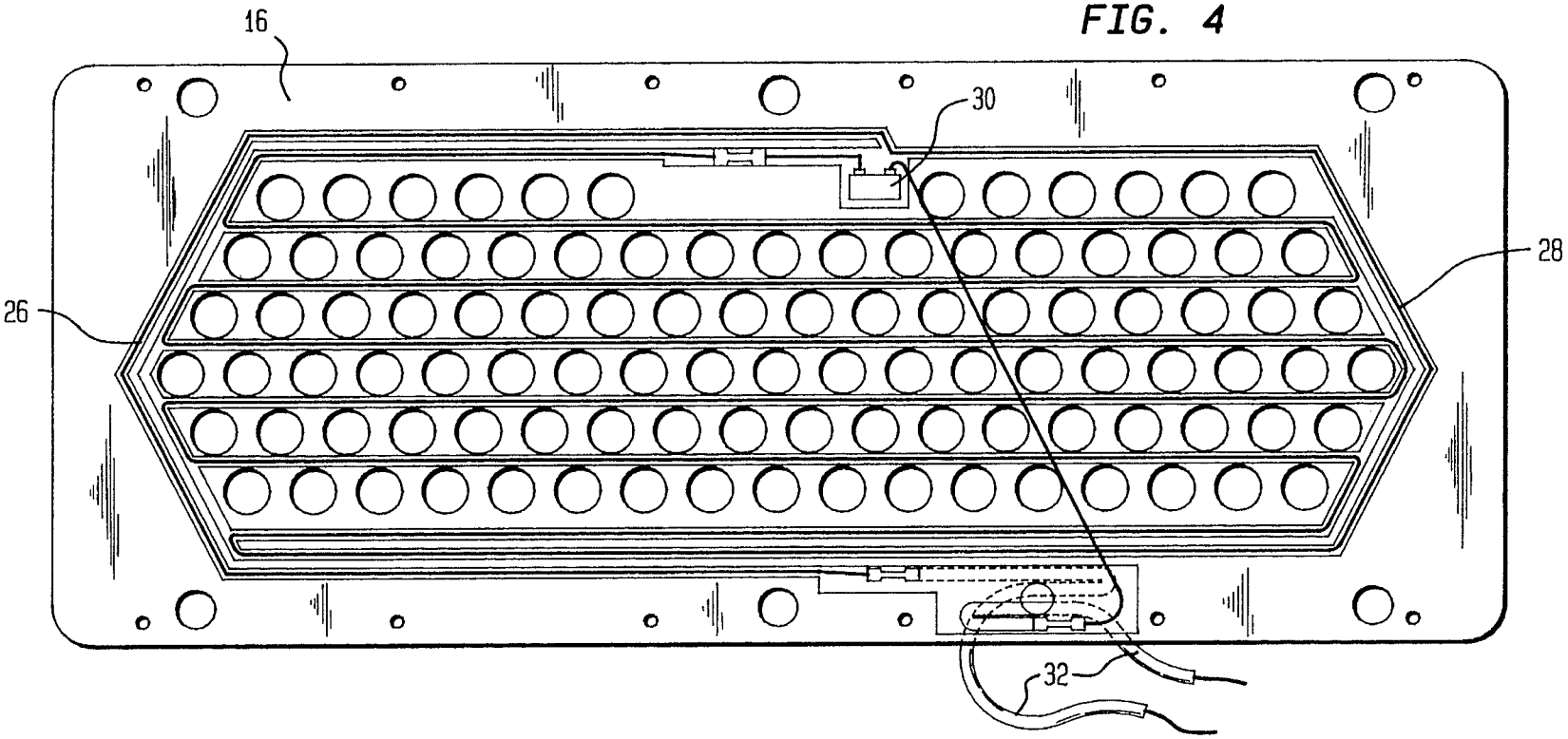
FIG. 4 shows a coupler in accordance with a preferred embodiment of the invention.

In accordance with the preferred embodiment of the invention as illustrated in FIG. 4, channels 26 are formed (as by milling) in the rear surface 16 of the coupler body 8 and extend between each two adjacent rows of pin assemblies. An electrical resistance element 28 is laid into the channels 26; in this example, the element is a single series circuit of THERMOWIRE, a proprietary product made by Cox & Company, Inc. (New York City), but another resistive element could be used instead and series-parallel circuits could also be used if desired. One end of the element 28 is connected to a thermostat 30. The thermostat 30 is thermally connected to the coupler body 8 and keeps the temperature of the coupler body 8 within a predetermined range; in the preferred embodiment, the thermostat is manufactured by Elmwood Sensors (Pawtucket, R.I.) closes at a temperature of 125° F. and opens at a temperature of 140° F. Lead-in wires 32 are connected across the series circuit formed by the element 28 and the thermostat 30; the wires 32 permit the element 28 to be energized by an exterior source (not shown). To seal the element 28 within the channels 26 and maximize conduction of heat from the element 28 to the coupler body 8, the channels 26 are filled with epoxy adhesive, advantageously type 2216 B/A Translucent as manufactured by 3M (St. Paul, Minn.). This adhesive is also used to seal the thermostat 30 within the coupler body 8 and to thermally connect it with the coupler body 8. This adhesive is chosen because it is flexible, has high shear and peel strengths and cures at room temperature, but another adhesive could be used instead.

In the preferred embodiment, the element 28 has a resistance of 1.78 Ω/foot and dissipates approximately 77 W when connected to a 37 VDC source. Over the temperature range in which the coupler 2 is to be used (−65° F. to +250° F.) this power dissipation is sufficient to evaporate reasonable quantities of moisture before that moisture causes corrosion or freezes. As a result, the service life of the electrical connectors 6 is prolonged and the coupler 2 need not be serviced as often. Furthermore, this power dissipation does not raise the temperature of the first coupler 2 above 140° F. For this reason, service personnel who touch the coupler 2 when the power has been turned on will not be burned. Because the element 28 is sealed within the coupler body 8, the element 28 is almost completely unsubjected to mechanical forces and is therefore expected to have a long service life.

Although the preferred embodiment of the invention uses a thermostat 30 to control temperature, use of a thermostat is not required. Another potentially cost-effective alternative might be to use a "self-regulating" element 28 in which the resistance of the element 28 is a function of its temperature. Furthermore, while the channels 26 in the preferred embodiment are straight between adjacent rows of pin assemblies, this is only for convenience. It may be preferable to make the channels 26 serpentine between adjacent rows of pin assemblies so they do not too closely approach the recesses 18.

Although a preferred embodiment has been described above, the scope of the invention is limited only by the following claims:

I claim:

1. A heated electrical coupler for use in environmentally exposed applications such as those between railroad cars, comprising:

a plurality of electrical connectors, each connector having
- a generally cylindrical body,
- a spring-loaded, electrically conductive pin retained within the body in such a manner as to project axially outwardly from the body and as to be capable of moving axially inwardly into the body against spring pressure when so urged by a corresponding pin on a mating coupler, and
- a terminal for making an electrical connection with the pin;

a coupler body having a front surface, a rear surface and a like plurality of recesses extending between the front and rear surfaces, each recess being dimensioned to receive a corresponding one of the connectors in such a manner that the pins project forwardly out of the front surface of the coupler body and the terminals project rearwardly out of the rear surface of the coupler body;

an electrical resistance element located in the coupler body adjacent the rear surface; and a backing plate having a like plurality of holes, the backing plate being secured to the coupler body and retaining the connectors therein in such a manner that the terminals project through the holes for connection to a wiring harness.

2. The coupler of claim 1, wherein the electrical connectors and recesses are arranged in elongated rows and the electrical resistance element extends between each two adjacent rows.

3. The coupler of claim 1, wherein the coupler body has channels in the rear surface and wherein the electrical resistance element is located in the channels.

4. The coupler of claim 3, wherein the channels are sealed up with the electrical resistance element located therein.

5. The coupler of claim 4, wherein the channels are sealed with an epoxy.

6. The coupler of claim 1, wherein the electrical resistance element is in series with a thermostat that is thermally connected with the coupler body.

7. The coupler of claim 1, wherein the electrical resistance element is embedded in the coupler body.

* * * * *

UNITED STATES PATENT AND TRADEMARK OFFICE

CERTIFICATE OF CORRECTION

PATENT NO. : 5,580,275

DATED : December 3, 1996

INVENTOR(S) : Raymond Bozek

It is certified that error appears in the above-indentified patent and that said Letters Patent is hereby corrected as shown below:

In the claims:

Claim 1 should read as follows:

1. A heated electrical coupler for use in environmentally exposed applications such as those between railroad cars, comprising:

a plurality of electrical connectors, each connector having a generally cylindrical body, a spring-loaded, electrically conductive pin retained within the body in such a manner as to project axially outwardly from the body and as to be capable of moving axially inwardly into the body against spring pressure when so urged by a corresponding pin on a mating coupler, and a terminal for making an electrical connection with the pin;

UNITED STATES PATENT AND TRADEMARK OFFICE

CERTIFICATE OF CORRECTION

PATENT NO. : 5,580,275
DATED : December 3, 1996
INVENTOR(S) : Raymond Bozek

It is certified that error appears in the above-indentified patent and that said Letters Patent is hereby corrected as shown below:

a coupler body having a front surface, a rear surface and a like plurality of recesses extending between the front and rear surfaces, each recess being dimensioned to receive a corresponding one of the connectors in such a manner that the pins project forwardly out of the front surface of the coupler body and the terminals project rearwardly out of the rear surface of the coupler body;

an electrical resistance element in direct thermal contact with the coupler body adjacent the rear surface; and a backing plate having a like plurality of holes, the backing plate being secured to the coupler body and retaining the connectors therein in such a manner that the terminals project through the holes for connection to a wiring harness.

Signed and Sealed this

Eleventh Day of November, 1997

Bruce Lehman

*Attest:*

BRUCE LEHMAN

*Attesting Officer*

*Commissioner of Patents and Trademarks*